United States Patent [19]

Blanchard, Jr. et al.

[11] 4,156,545

[45] May 29, 1979

[54] PROCESS FOR HEATING AND CHEMICALLY TREATING AN AQUEOUS PROCESS FLUID

[75] Inventors: William J. Blanchard, Jr., New Orleans; Marion J. Dionne, Thibodaux; Edward J. Cairns, New Orleans, all of La.

[73] Assignee: Freeport Minerals Company, New York, N.Y.

[21] Appl. No.: 787,437

[22] Filed: Apr. 14, 1977

[51] Int. Cl.[2] ..... E21C 41/14

[52] U.S. Cl. ..... 299/6; 166/303; 210/57

[58] Field of Search ..... 252/8.55 R; 299/3, 4, 299/6; 210/57

[56] References Cited

U.S. PATENT DOCUMENTS

| | | | |
|---|---|---|---|
| 2,041,397 | 5/1936 | Butterworth et al. | 210/16 |
| 2,113,198 | 4/1938 | Nonhebel et al. | 423/242 |
| 2,756,035 | 7/1956 | Axelrad et al. | 299/6 X |
| 2,756,207 | 7/1956 | Axelrad | 210/14 |
| 2,756,208 | 7/1956 | Axelrad et al. | 210/14 |
| 2,947,690 | 8/1960 | Axelrad | 210/57 |
| 3,918,521 | 11/1975 | Snavely et al. | 166/272 |

*Primary Examiner*—Herbert B. Guynn
*Attorney, Agent, or Firm*—Fisher, Christen & Sabol

[57] ABSTRACT

An integrated system and process is provided to heat and chemically treat an aqueous process fluid such as the water required for producing sulfur by the Frasch process without undue scaling and corrosion of apparatus when a sulfur-containing fuel such as oil is employed as the energy source.

8 Claims, 1 Drawing Figure

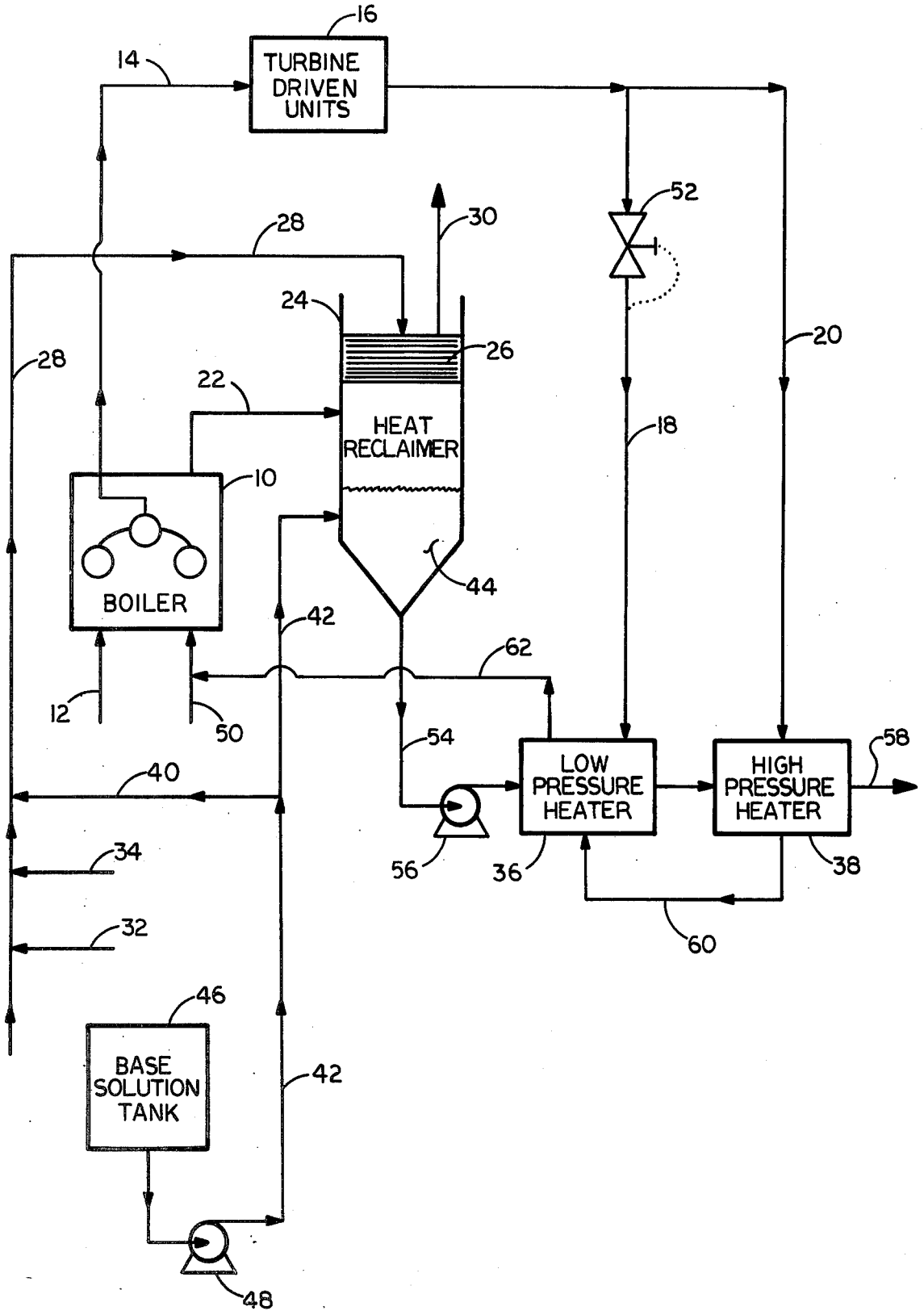
16
TURBINE DRIVEN UNITS
14
52
30
28
24
26
20
28
22
HEAT RECLAIMER
18
10
BOILER
44
42
62
12
50
54
58
40
LOW PRESSURE HEATER
HIGH PRESSURE HEATER
34
56
36
38
32
60
46
BASE SOLUTION TANK
42
48

PROCESS FOR HEATING AND CHEMICALLY TREATING AN AQUEOUS PROCESS FLUID

BACKGROUND OF THE INVENTION

1. Field of the Invention

The present invention relates to the heating and chemical treatment of aqueous process fluids such as the aqueous mining fluid used in the Frasch process for mining sulfur. More particularly, the present invention relates to the heating and chemical treatment of such aqueous process fluids using a sulfur-containing fuel as the energy source.

2. Description of the Prior Art

The Frasch process for mining sulfur is well known to those skilled in the art, and a description of its operation may be found in the patent literature and in numerous chemistry books and encyclopedias including, for example, the *Kirk-Othmer Encyclopedia of Chemical Technology,* Second Edition, Vol. 19, pp. 337–348, John Wiley & Sons, Inc., 1969. In the Frasch process, a hot aqueous mining fluid, e.g., water, is used to melt the solid sulfur present in an underground sulfur-bearing formation by injecting the fluid, heated under pressure to around 325° F., through the annulus formed by two concentric pipes and using compressed air to lift the molten sulfur to the surface through the inner pipe. The air is usually forced down through a small diameter pipe located within the described concentric arrangement.

Until recent years, the source of heat for the operation of a Frasch process sulfur mine has been the relatively abundant, low-cost supply of sulfur-free gas. However, as these reserves dwindle and gas supplies, when available, soar in price, it is becoming increasingly necessary to resort to the use of other fuels.

The use of sulfur-free natural gas as the fuel and source of heat in Frasch sulfur mining operations permitted attainment of relatively high overall plant efficiencies, due in part to the fact that even the heat in the effluent combustion gases from the steam-generating boilers could be reclaimed by the incoming cold aqueous mining fluid through intimate, direct contact of the fluid and combustion gases in heat exchange units appropriately labeled "flue gas heat reclaimers".

In addition to providing low-level heat to the incoming aqueous mining fluid, a consequence of which was to reduce the oxygen content of the fluid and render it less corrosive, the combustion gases also provided carbon dioxide, a portion of which dissolved in the fluid, lowering its pH and thereby lessening its tendency to lay down alkaline scale deposits in the subsequent high-temperature heating stages.

Now that natural gas is relatively unavailable to industrial operations, it is becoming necessary to resort to the use of other fuels such as oil or coal, both of which usually contain varying amounts of sulfur. If these materials are used as fuel in the boilers and the resultant combustion gases used in the usual economical manner, i.e., by passing them through flue gas heat reclaimers to scavenge the heat, the aqueous mining fluid undergoes reduction in dissolved oxygen content, picks up scale-mitigating carbon dioxide, and dissolves large amounts of sulfur dioxide which are present in the combustion gases as the result of combustion of the sulfur in the fuel. Dissolution of this sulfur dioxide results in two problems. First, this acid gas lowers the pH of the fluid (makes it more acidic), thereby increasing the fluids corrosivity towards metals in the system. Secondly, there is an increased tendency towards deposition of calcium sulfite scale because of this material's extremely low solubility in aqueous fluids. In order to circumvent these problems it is possible to employ a system whereby the heat in the $SO_2$-containing flue gases is transferred to the aqueous fluid by indirect heat exchangers ("economizers") so that a considerable proportion of the heat normally reclaimed in direct contact heat reclaimers is still attained.

Such a system has serious drawbacks, however, such as, for example:

1. In order to offset the lack of $CO_2$ pickup by the aqueous fluid in the indirect heat exchange system, a mineral acid has to be added, at some cost, to adjust the pH of the fluid so as to prevent the alkaline scale deposition previously described;

2. Cooling of the flue gases in the economizers results in condensation of water vapor which dissolves sulfur dioxide and carbon dioxide and produces a very serious corrosion problem with respect to the materials of construction of the economizer (unless the economizer were constructed of extremely costly acid-resistant alloys) since heat transfer tubes of normal low-cost materials of construction cannot be protected by coatings, etc., and still provide the required heat exchange rates; and 3. The incoming cold aqueous mining fluid should receive prior treatment with an oxygen-scavenging chemical to prevent extreme corrosion in the economizer as well as in the heat exchangers subsequently employed to heat the water to mining temperatures. While the chemical reactions involved in the removal of dissolved oxygen are fairly rapid at elevated temperatures, at the ambient temperatures of this system the reaction rates are very slow, unless increased by the use of a costly catalyst in addition to the oxygen-scavenging chemical, for example, by the use of cobaltous sulfate as a catalyst to promote the reaction between dissolved oxygen and an oxygen scavenger such as sodium sulfite.

SUMMARY OF THE INVENTION

It is therefore a primary object of the present invention to provide a process for economically heating and chemically treating an aqueous process fluid such as the aqueous mining fluid in the Frasch sulfur mining process.

It is another object of the present invention to provide such a process which permits the use of sulfur-containing fuels such as coal, oil, sour gas, etc., but which at the same time effectively eliminates the corrosion and scaling potential normally attendant upon the use of such fuels.

Still further objects and the entire scope of applicability of the present invention will become apparent from the accompanying drawing and detailed description given hereinafter; it should be understood, however, that the drawing and detailed description, while indicating preferred embodiments of the invention, are given by way of illustration only, since various changes and modifications within the spirit and scope of the invention will become apparent to those skilled in the art.

It has been found that the above objects may be attained by a process for heating and chemically treating an aqueous fluid which comprises burning a sulfur-containing fuel to produce hot combustion gases containing carbon dioxide and sulfur dioxide, adjusting the pH of the aqueous fluid to 6.7 or below with a base, directly contacting said aqueous fluid with said hot combustion gases to heat said aqueous fluid and absorb carbon dioxide and sulfur dioxide therein, and adding additional base to said aqueous fluid following said contacting whereby the heated aqueous fluid has a pH between 6.0 and 6.7.

In one preferred embodiment, the hot combustion gases are first brought into indirect contact with high-quality boiler feedwater to convert said water into high pressure steam and said steam is used to further heat said heated aqueous mining fluid. In another preferred embodiment, at least a portion of said high pressure steam is first used to generate electrical and mechanical energy and the exhaust steam from the energy-generation equipment then used to further heat said heated aqueous mining fluid. The fluid is preferably heated to a temperature suitable for the mining of sulfur and is used as the aqueous mining fluid in the Frasch sulfur mining process to provide an integrated system such as shown in the drawing.

BRIEF DESCRIPTION OF THE DRAWING

The single FIGURE is a schematic flowsheet of a preferred embodiment of the integrated system for heating and chemically treating an aqueous mining fluid for producing sulfur by the Frasch mining process.

As shown in the drawing, the subject integrated system of the present invention involves a boiler 10 which burns a sulfur-containing fuel from line 12 and produces a flue gas which is fed through line 22 to flue gas heat reclaimer 24 into which an aqueous mining fluid flows through line 28 and is distributed over packed bed 26 and heated by the rising flue gases. Prior to entering the flue gas heat reclaimer, the aqueous fluid in line 28 is treated with an injection of a solution of a base, e.g., a soda ash solution, from tank 46 via pump 48 and line 40. The partially heated aqueous fluid is then again treated in the storage zone 44 of heat reclaimer 24 with additional basic solution from tank 46 through line 42. The amount of basic solution added must be controlled to adjust the pH of the aqueous solution, before it exits reclaimer 24, to between 6.0 and 6.7. The thus treated water exits the lower portion of heat reclaimer 24 through line 54 at 120°–130° F. and a pH of 6.0–6.7, and is then pumped by mine water pump 56 to low-pressure pressure and high-pressure steam heat exchangers 36 and 38, respectively, from which it emerges with a pH of 6.0–6.7 and a temperature of approximately 325° F.

DESCRIPTION OF THE PREFERRED EMBODIMENTS

In the preferred embodiment of the invention shown in the drawing, the system operates as follows:

Assuming normal on-stream, steady-state operation, boiler 10 is fired with a fuel oil fed through line 12 and containing not more than 1.0%, and preferably 0.3–0.7%, by weight sulfur to produce high-pressure steam which exits boiler 10 through line 14 and is used in turbine-driven equipment 16 and, after pressure reduction, in heaters 36 and 38 as low-pressure exhaust steam in lines 18 and 20 for heating the aqueous mining fluid as will be discussed in more detail hereinafter. Boiler 10 also produces a flue gas which, at a temperature of from 600° F. to 800° F., e.g., about 700° F., is fed through line 22 to flue gas heat reclaimer 24 wherein it flows upwardly through packed bed 26 of the reclaimer and comes into direct contact with incoming aqueous mining fluid fed through line 28. In packed bed 26 the temperature of the fluid is raised from ambient temperature, e.g., about 70° F., to from about 120° F. to about 130° F., e.g., 130° F., by transfer of heat from the hot flue gases. The thus cooled flue gases leave the top of heat reclaimer 24 at a temperature of from 80° F. to about 130° F., e.g., about 100° F., through line 30.

The preferred sulfur-containing fuels for use in the process of the present invention are oil and coal. However, any fuel containing not more than 1.0% by weight sulfur can be used. An example of another suitable fuel is sour gas. The packed bed 26 of heat reclaimer 24 may be packed with berl saddles, raschig rings, lessing rings, or other similar type of packing material constructed of ceramic, procelain or other corrosion resistant material, as is well-known in the art. The packed bed operates by increasing the interfacial area for heat transfer and mass transfer and the intimacy of contact of phases between which heat transfer and mass transfer is effected.

The aqueous fluid fed to heat reclaimer 24 through line 28 may be seawater that has been treated with a chlorine solution fed through line 32 or it may be a mixture of chlorine-treated seawater and brine fed through line 34, or it may even be brackish water, fresh river water, "bleedwater", etc. "Bleedwater" is a term used in the Frasch sulfur mining industry to denote the water that must be bled from the sulfur mine formation to control the mine pressure and which is normally treated and pumped to waste. The seawater may be treated with an aqueous chlorine solution containing from 100 to 600 parts per million chlorine for the purpose of preventing marine fouling of the equipment through which the seawater will pass in the system. Irrespective of the type of water used, when it contacts the flue gases from boiler 10 in heat reclaimer 24, the aqueous fluid will absorb heat, carbon dioxide ($CO_2$) and sulfur dioxide ($SO_2$), the latter resulting from the combustion of the sulfur in the sulfur-containing fuel.

The presence of the dissolved carbon dioxide and sulfur dioxide in the aqueous fluid has both desirable and undesirable features. The desirable features are that both the carbon dioxide and the sulfur dioxide tend to lower the pH of the fluid and, as a result, prevent or minimize the amounts of alkaline carbonate and alkaline hydroxide scale deposition that will occur when the fluid is subsequently heated in low-pressure and high-pressure heaters 36 and 38. However, of even more importance, the sulfur dioxide reacts with residual dissolved oxygen and, as a result, lessens the corrosive potential of the fluid which is due to oxygen contained therein. The presence of sulfur dioxide, then, can eliminate the cost of chemicals such as sodium sulfite which are otherwise needed in order to scavenge oxygen and control corrosion in these systems. It should be noted that no real detrimental effect results from the presence of carbon dioxide, unless it were to be present in excessively high concentrations.

The undesirable and detrimental features are that the sulfur dioxide can cause scale deposition in heaters 36 and 38 due to the relatively low solubility of the calcium sulfite that tends to form when sulfur dioxide is present, and that an excess of dissolved sulfur dioxide can lower the pH of the fluid to the point where it becomes corrosive. In order to overcome the above-mentioned undesirable and detrimental features and at the same time take advantage of the advantageous features which result from the presence of carbon dioxide and sulfur dioxide in the flue gas-heated aqueous fluid, the present invention provides for a first injection of a solution of a base, e.g., a soda ash solution, through line 40 into the aqueous fluid in line 28 prior to entering heat reclaimer 24 whereby the pH of the aqueous fluid is adjusted to between about 6.0and 6.7, e.g., to 6.3, and a second injection of the same solution of the base through line 42 into the water-storage zone 44 of heat reclaimer 24 in which the water is heated from ambient temperature, e.g., about 70° F. to about 120°-130° F. This assures that the pH lowering effect of the carbon dioxide and sulfur dioxide which are dissolved in the aqueous fluid during direct contact thereof with the flue gases in heat reclaimer 24 will be offset and that the pH of the aqueous fluid in and withdrawn from storage zone 44 will be maintained between 6.0 and 6.7. In addition, the present invention provides for the use of a sulfur-containing fuel having not more than 1.0% by weight sulfur, e.g., from 0.01% to 1.0% by weight, and preferably 0.3-0.7% by weight, sulfur. The combination of the use of a fuel having not more than 1.0% by weight sulfur and the injection of the solution of a base at the two points described above to adjust the pH of the aqueous fluid leaving heat reclaimer 24 to between 6.0 and 6.7 permits the system to be operated without any significant scale deposition and without any significant corrosion of the metallic components of the system which contact the water after it has left heat reclaimer 24. It is necessary that the amounts of soda ash added to the water be controlled so as to avoid raising the pH above 6.7. If too much base is used and the pH of the aqueous fluid rises above 6.7, insoluble calcium carbonate ($CaCO_3$) and insoluble calcium sulfite ($CaSO_3$) will begin to form in increased quantities and their precipitation will scale the tubes of heaters 36 and 38. If the pH is too low, i.e., below about 6.0, the water will be too corrosive for the materials of construction normally used in the heaters. On the other hand, if the pH of the aqueous fluid leaving heat reclaimer 24 is maintained between 6.0 and 6.7, and preferably about 6.3, soluble bisulfites and bicarbonates will be maintained in solution, and their presence in the fluid will not interfere with the heat transfer in the heat exchangers.

In a preferred embodiment of the present invention, boiler 10 is fed fuel oil having about 0.3-0.7% by weight sulfur through line 12 and boiler feedwater through line 50. High-pressure steam having a pressure of from about 575 to about 650 psig, e.g., about 600 psig, is generated in boiler 10 and passed through line 14 to drive turbine-driven equipment 16. The turbine-driven equipment may be, for example, steam turbines connected to electric generators which produce electricity for use in the treating plant or elsewhere, or may be pumps, air compressors and various other pieces of equipment needed in the operation of the integrated facility. The exhaust steam from turbine driven equipment 16 has a pressure of from about 85 to about 100 psig, e.g., about 95 psig. A portion of the exhaust steam is passed through pressure reducing valve 52 wherein the pressure is reduced to from about 45 to about 55 psig, e.g., about 50 psig, and then passes through line 18 to low-pressure heater 36. Another portion of the exhaust steam is passed through line 20 to high-pressure heater 38. The treated aqueous fluid in storage zone 44 of heat reclaimer 24, having a temperature of about 120° to about 130° F. and a pH of from 6.0 to 6.7 is withdrawn through line 54 and passed through pump 56 to low-pressure heater 36 wherein the temperature of the fluid is raised to from about 265° to about 285° F., e.g., about 275° F., and then to high-pressure heater 38 wherein the temperature of the aqueous fluid is raised to from about 300° F. to about 330° F., e.g., about 325°F., which is usually the required mining temperature range for an aqueous sulfur mining fluid. The heated mining fluid, or "booster water", is sent from high-pressure heater 38 through line 58 to the wells for melting the sulfur in the underground formation. Steam condensate 60 from the shell of high-pressure heater 38 is trapped and fed into the shell of low-pressure heater 36, wherein it is flashed to the steam pressure therein being maintained. The steam condensate 62 from the shell of low-pressure heater 36 is eventually returned to boiler 10, preferably via stream 50.

While soda ash ($Na_2CO_3$) is the preferred base for use in the pH adjustment steps of the present invention, it is also possible to use other bases such as lime (CaO) or hydrated lime ($Ca(OH)_2$)instead of soda ash. The cost of hydrated lime, for example, is only about 30% of that of soda ash and, since only about 75% by weight as much hydrated lime as soda ash is required for the treatment, the pH-adjustment steps may be carried out at about 22% of the cost of using soda ash when hydrated lime is substituted for soda ash.

The use of lime for this purpose, however, will result in an increase in the calcium content of the mine water, and hence the extent to which lime may be used in place of soda ash will depend on the calcium and sulfate concentrations in the aqueous fluid, e.g., seawater and brine, with which it is admixed in the pH-adjustment steps. The principal consideration will be the ability to maintain an arithmetic product of calcium concentration times sulfate concentration in the water that does not exceed the solubility product of the system at the elevated temperatures in the low-pressure and high-pressure heaters, so as to avoid significant amounts of calcium sulfate scaling in the tubes of these heaters. It is thus possible to use mixtures of lime or hydrated lime and soda ash, in addition to lime or hydrated lime only or soda ash only. In most cases, the solution of the base should contain from 1.0% by weight up to the saturation point of the base in the solvent, such as water, e.g., in the case of soda ash the solution should contain between 1 and 14% by weight $Na_2CO_3$. Another base which may be used is sodium hydroxide (NaOH).

EXAMPLE

Using the integrated system shown in the drawing, a fuel oil containing about 0.7% by weight sulfur was burned in boiler 10 to convert boiler feedwater into steam having a pressure of 600 psig. The flue gases from boiler 10 having a temperature of 700° F. were fed into heat reclaimer 24. At the same time, a mixture of chlorine-treated seawater and brine was injected with an 8.0% by weight solution of soda ash to adjust the pH of the mixture to about 6.3 and fed into the heat reclaimer, brought into direct contact with the flue gases therein, heated thereby to a temperature of 130° F. and collected in water storage zone 44 of the heat reclaimer. Following said direct contact, additional soda ash solution was added to the heat reclaimer to maintain the pH of the heated aqueous mixture in the storage zone at about 6.3. The steam generated in boiler 10 was used to operate turbine driven equipment 16 and the exhaust steam therefrom had a pressure of 95 psig. A portion of the exhaust steam was passed through pressure reducing valve 52 wherein the pressure was reduced to 50 psig and then passed to low-pressure heater 36. Another portion of the exhaust steam was passed to high-pressure heater 38. The treated and partially heated aqueous mixture in storage zone 44 was passed through low-pressure heater 36 wherein its temperature was raised to 275° F. and through high-pressure heater 38 wherein its temperature was raised to 325° F. and was then used as an aqueous sulfur mining fluid. No substantial scaling or corrosion was observed in heaters 36 and 38.

What is claimed is:

1. A process for heating and chemically treating an aqueous fluid which comprises burning a sulfur-containing fuel having not more than 1.0% by weight sulfur to produce hot combustion gases containing carbon dioxide and sulfur dioxide, adjusting the pH of said aqueous fluid to between about 6.0 and 6.7 with a base, directly contacting said aqueous fluid with said hot combustion gases to heat said aqueous fluid and absorb carbon dioxide and sulfur dioxide therein, adding additional base to said aqueous fluid following said step of directly contacting said aqueous fluid with said combustion gases whereby the heated aqueous fluid has a pH between 6.0 and 6.7, and indirectly heating the aqueous fluid obtained in the second pH adjustment step to a temperature of from about 300° F. to 300° F., whereby soluble bisulfites and bicarbonates are maintained in solution during the step of indirectly heating said aqueous fluid.

2. The process according to claim 1 wherein said aqueous fluid is directly heated to a temperature of from about 120° F. to 130° F.

3. The process according to claim 1 wherein said hot combustion gases are first brought into indirect contact with water to convert said water into steam and said steam is used to indirectly heat the heated aqueous fluid.

4. The process according to claim 3 wherein said heated aqueous fluid indirectly heated to a temperature of between 300° F. and 330° F. by said steam is injected into an underground sulfur bearing formation and used as the aqueous mining fluid in the Frasch sulfur mining process.

5. The process according to claim 3 wherein at least a portion of said steam is first used to generate electrical and mechanical energy in energy-generation equipment and the exhaust steam from said energy-generation equipment is then used to indirectly heat said heated aqueous fluid.

6. The process according to claim 1 wherein said sulfur-containing fuel is coal or oil.

7. The process according to claim 1 wherein said base is selected from the group consisting of soda ash, lime, hydrated lime and mixtures thereof.

8. The process according to claim 7 wherein said base is soda ash.

* * * * *